US008180095B2

(12) United States Patent
Zhang

(10) Patent No.: US 8,180,095 B2
(45) Date of Patent: May 15, 2012

(54) PORTABLE SPEAKER DEVICE AND PORTABLE AUDIO DEVICE PLAYER

(75) Inventor: Yongde Zhang, Guang Dong (CN)

(73) Assignee: Coby Electronics Corporation, Lake Success, NY (US)

( * ) Notice: Subject to any disclaimer, the term of this patent is extended or adjusted under 35 U.S.C. 154(b) by 987 days.

(21) Appl. No.: 12/159,844

(22) PCT Filed: Jan. 3, 2007

(86) PCT No.: PCT/US2007/060051

§ 371 (c)(1),
(2), (4) Date: Jan. 3, 2007

(87) PCT Pub. No.: WO2007/079478

PCT Pub. Date: Jul. 12, 2007

(65) Prior Publication Data

US 2008/0304692 A1 Dec. 11, 2008

Related U.S. Application Data

(60) Provisional application No. 60/755,766, filed on Jan. 4, 2006.

(51) Int. Cl.
*H04R 1/02* (2006.01)

(52) U.S. Cl. ..... 381/387; 381/334; D14/209.1

(58) Field of Classification Search ..... 381/332, 381/334, 386, 387; D14/209.1
See application file for complete search history.

(56) References Cited

U.S. PATENT DOCUMENTS

| | | | | |
|---|---|---|---|---|
| 6,057,659 | A * | 5/2000 | Akiyama et al. | 381/98 |
| 6,151,401 | A | 11/2000 | Annaratone | |
| 6,760,456 | B1 * | 7/2004 | Annaratone | 381/306 |
| 6,968,068 | B1 | 11/2005 | Amsel | |
| 7,278,734 | B2 * | 10/2007 | Jannard et al. | 351/158 |
| D598,896 | S * | 8/2009 | Garrett | D14/209.1 |
| D599,782 | S * | 9/2009 | Tse | D14/209.1 |
| D601,546 | S * | 10/2009 | Lee et al. | D14/209.1 |
| 7,599,725 | B2 * | 10/2009 | Park et al. | 455/575.7 |
| D620,922 | S * | 8/2010 | Skurdal | D14/209.1 |
| D633,080 | S * | 2/2011 | Wakabayashi | D14/209.1 |
| 2005/0244025 | A1 | 11/2005 | Schul et al. | |
| 2006/0240881 | A1 * | 10/2006 | Cho et al. | 455/575.4 |
| 2008/0220812 | A1 * | 9/2008 | Wang | 455/550.1 |
| 2008/0279406 | A1 * | 11/2008 | D'Hoogh | 381/332 |
| 2008/0304692 | A1 * | 12/2008 | Zhang | 381/387 |

FOREIGN PATENT DOCUMENTS

WO PCT/US2007/060051 * 7/2007

* cited by examiner

*Primary Examiner* — Mary Wilczewski
(74) *Attorney, Agent, or Firm* — Mayer Brown LLP

(57) ABSTRACT

A portable speaker device that includes a frame configured to receive a portable audio device and at least two speakers that are slidably-connected to the frame. The speakers have a first position for providing a substantially extended configuration and a second position for providing a substantially retracted configuration. The portable speaker device also includes a flush hinged sub-assembly that includes a contoured element and arcuate arms extending from a support and rotatably coupled to the frame at the distal ends of the arcuate arms.

31 Claims, 8 Drawing Sheets

PORTABLE SPEAKER DEVICE AND PORTABLE AUDIO DEVICE PLAYER

PRIORITY INFORMATION

This application claims priority of Provisional Application Ser. No. 60/755,766 filed on Jan. 4, 2006.

BACKGROUND OF THE INVENTION

1. Field of the Invention

The present invention relates generally to audio components, and more particularly to portable speaker/audio reproduction devices.

2. Description of Related Art

Portable speaker systems for use with electronic devices are increasingly being used by individuals. Collapsible and portable speaker assemblies for use with audio-capable devices are known in the art, and such assemblies have been configured into many forms. Existing speaker assemblies and speaker systems that are collapsible as well as portable in design, however, generally are bulky, heavy and costly to manufacture. Moreover, such assemblies are typically not conveniently stored or transported from one destination to another.

Furthermore, as digital storage capacity continues to increase, users are able to carry more and more of the music they like with them in an ever-increasing array of audio-capable devices, including, but not limited to, digital cameras, portable digital assistants (commonly referred to as PDA's), wireless telephones, all-in-one devices combining two or more functionalities, and the like. Most of these audio-capable devices, however, are designed to be highly portable and, therefore, are limited so as to present the reproduced audio to a user only through monaural or stereo headphones that are plugged into the audio device. This means that, at best, these audio devices can only be used to reproduce audio tracks for a limited number of users, such as when one or more splitters are used to allow multiple users to plug headphones into the device.

One limitation of powered speakers is that they are frequently sold as stand-alone units, without a carrying case or other means for simplifying their transportation. The speakers also tend to take a lot of physical abuse during transportation, and frequently the cables and adaptors used to connect the speakers to the audio device are not capable of withstanding such abuse.

Accordingly, there exists a need for improvement in the design of portable speaker systems to overcome the deficiencies discussed above. The present invention meets these needs and others, as will be apparent to those of skill in the art.

BRIEF SUMMARY OF THE INVENTION

An object of the present invention is to provide a portable speaker device that includes a support and is configured to carry a portable audio device. Another object of the present invention is to provide a portable speaker device where the speakers are slidably-connected to the device and/or are rotatable. Yet another object of the present invention is to provide a portable speaker device with a rotatable support that is coupled to a frame with a flush hinged sub-assembly such that the force required to remove the support from the frame or to break the support off of the frame is greater than in conventional devices.

In an embodiment of the present invention, a portable speaker device is provided. The portable speaker device includes a frame configured to receive a portable audio device, at least two speakers slidably-connected to the frame wherein the at least two speakers have a first position for providing a substantially extended configuration and a second position for providing a substantially retracted configuration, and a support that is rotatably connected to the frame. The support is rotatable between a supporting position where the at least two speakers are exposed and a covering position where the at least two speakers are at least partially covered by the support.

In certain embodiments, the portable speaker device may be configured such that a space is provided between the at least two speakers that is sufficient to accommodate the portable audio device when the at least to speakers are in the substantially extended position. Further, the space provided between the at least two speakers that is sufficient to accommodate the portable audio device when the at least to speakers are in the substantially extended position may be substantially eliminated when the at least to speakers are in the substantially retracted position. Additionally, an electrical connector for connecting the portable audio device to the frame may be substantially covered when the at least to speakers are in the substantially retracted position.

Alternatively, the electrical connector may be a docking cradle for receiving the portable audio device.

In certain embodiments, the at least two speakers may be rotatable around an axis that is substantially perpendicular to the sliding axis of the at least two speakers in at least the substantially extended position.

In some embodiments of the present invention, the portable speaker device may also include a flushed hinge sub-assembly including a contoured element and arcuate arms extending from the support and rotatably coupled to the frame at the distal ends of the arcuate arms. The contoured element may be shaped such that one side of the contoured element mates with a respective side of the arcuate arm to form a continuous surface on the exterior of the frame in the supporting position and another side of contoured elements mates with another respective side of the arcuate arm to form a continuous surface on the exterior of the frame in the covering position.

The contoured element may provide additional support to the portable speaker device when the support is in the supporting position and may also increase the force required to separate the support from the frame. The contoured element may also provide at least a partial seal around the support when the support is in the closed position to protect the at least two speakers and may also be configured to mate with the support at a predetermined position to provide a stopping point for the support in the supporting position that is about 270 degrees (in some embodiments, the stopping angle may be between about 200-300 degrees) from the closed position.

In another embodiment of the present invention, a portable speaker device may be provided that includes a frame configured to receive a portable audio device, at least two speakers slidably-connected to the frame, wherein the at least two speakers have a first position for providing a substantially extended configuration and a second position for providing a substantially retracted configuration, and a flush hinged sub-assembly. The flushed hinge assembly may include a contoured element; and arcuate arms extending from a support and rotatably coupled to the frame at the distal ends of the arcuate arms and the contoured element may be shaped such that one side of the contoured element mates with a respective side of the arcuate arm to form a continuous surface on the exterior of the frame in the supporting position and another side of contoured elements mates with another respective side of the arcuate arm to form a continuous surface on the exterior of the frame in the covering position.

In yet another embodiment of the present invention, a system may be provided that includes a frame configured to receive a portable audio device, at least two speakers connected to the frame, and a flush hinged sub-assembly. The flushed hinge assembly may include a contoured element, and arcuate arms extending from a support and rotatably coupled to the frame at the distal ends of the arcuate arms and the contoured element may be shaped such that one side of the contoured element mates with a respective side of the arcuate arm to form a continuous surface on the exterior of the frame in the supporting position and another side of contoured elements mates with another respective side of the arcuate arm to form a continuous surface on the exterior of the frame in the covering position.

BRIEF DESCRIPTION OF THE DRAWINGS

Additional objects, features, and advantages of the present invention will become apparent from the following detailed description of embodiments of the invention in conjunction with the accompanying drawings where like reference numerals indicate like features, in which.

DETAILED DESCRIPTION OF THE PREFERRED EMBODIMENTS

The portable speaker system of the present invention is designed to be communicatively coupled with one or more audio devices or portable audio devices. As used herein, an audio device or a portable audio device is an electronic device capable of outputting at least an audio signal including devices that also output video signals and still images.

In one embodiment, the present invention includes an adaptor by which the portable speaker system can be connected to one or more portable audio devices. By way of example, and without limiting the present invention, the portable speaker system may include a docking cradle for attaching an iPod™ (digital storage device) to the portable speaker system, thereby allowing the portable speaker system to reproduce audio signals from the iPod.

In an alternative embodiment, the docking cradle provided by the present invention may support multiple, interchangeable connection means, thus allowing a plurality of portable audio devices, satellite radio receivers, digital radio receivers, standard radio receivers, CD/DVD players, or other audio devices to be communicatively coupled with the portable speaker system. The signal received by the system from the audio device may be either digital or analog, and the audio device may be detachable from the system or permanently connected.

Figure 1:
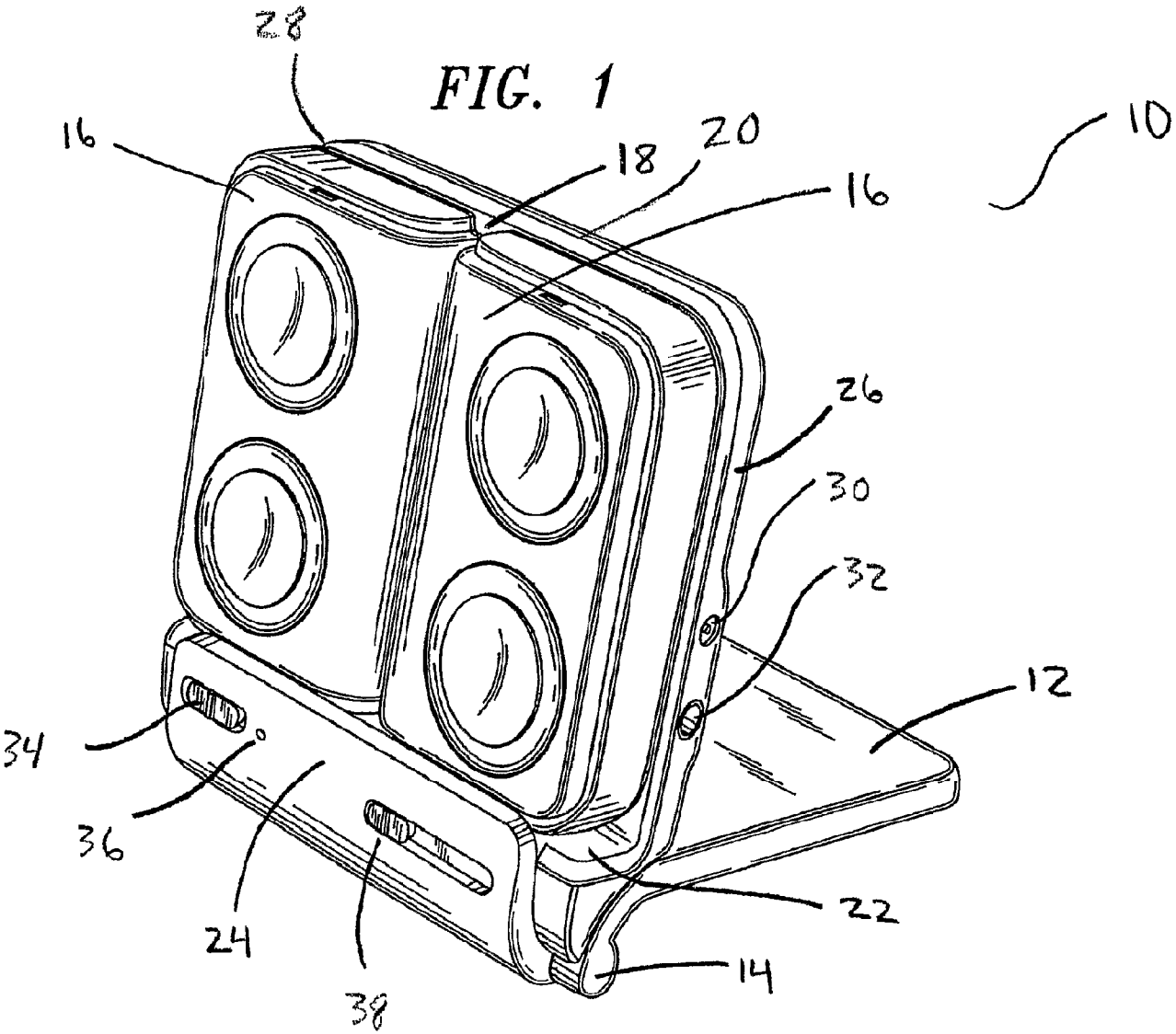
FIG. 1 is a perspective view of a portable speaker system according to an embodiment of the present invention (with the support in fully open/supporting position and speakers in closed/retracted position)
Figure 2:
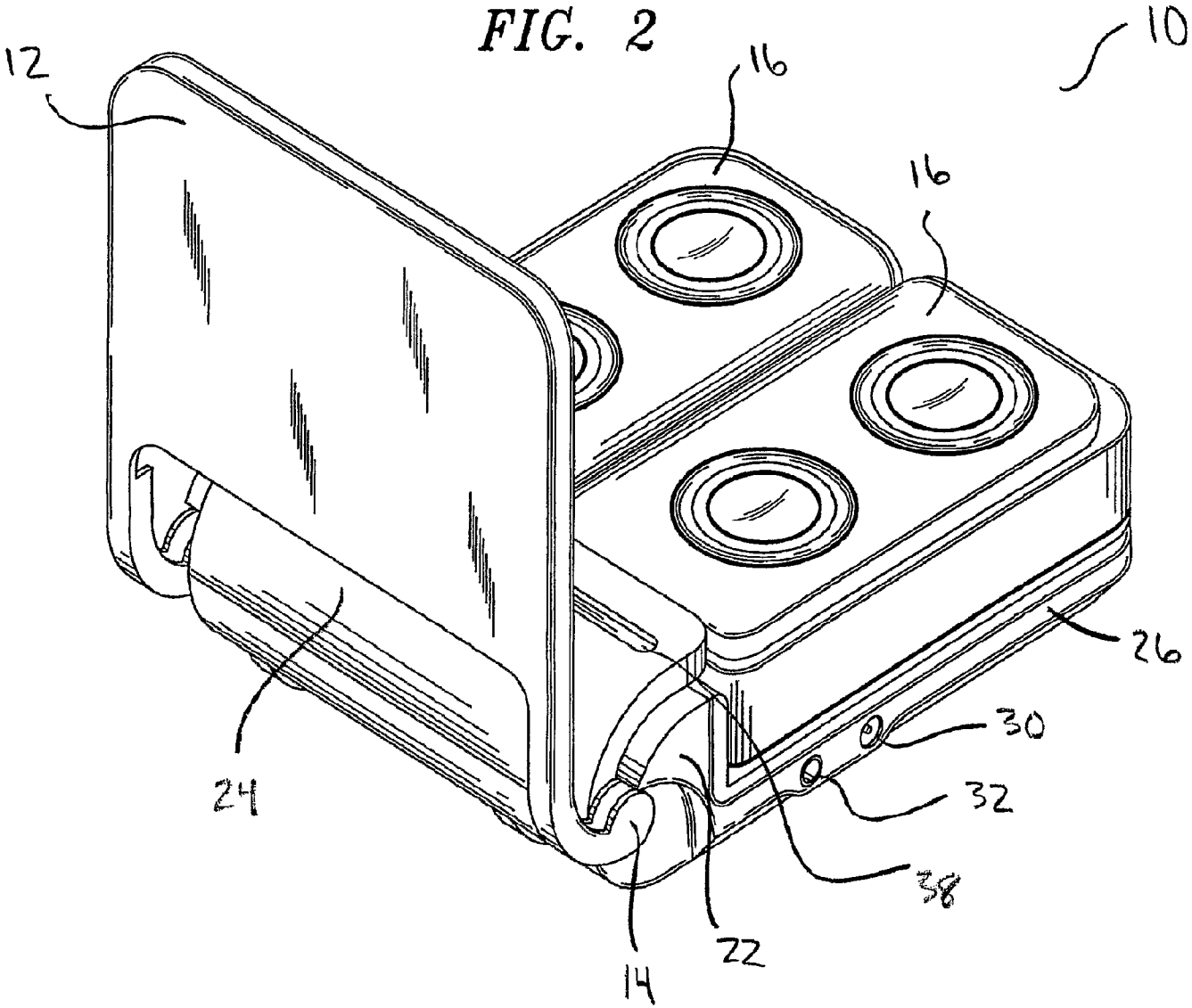
FIG. 2 is a perspective view of the portable speaker system of FIG. 1 (with the support in partially open/supporting position and speakers in closed/retracted position)
Figure 3:
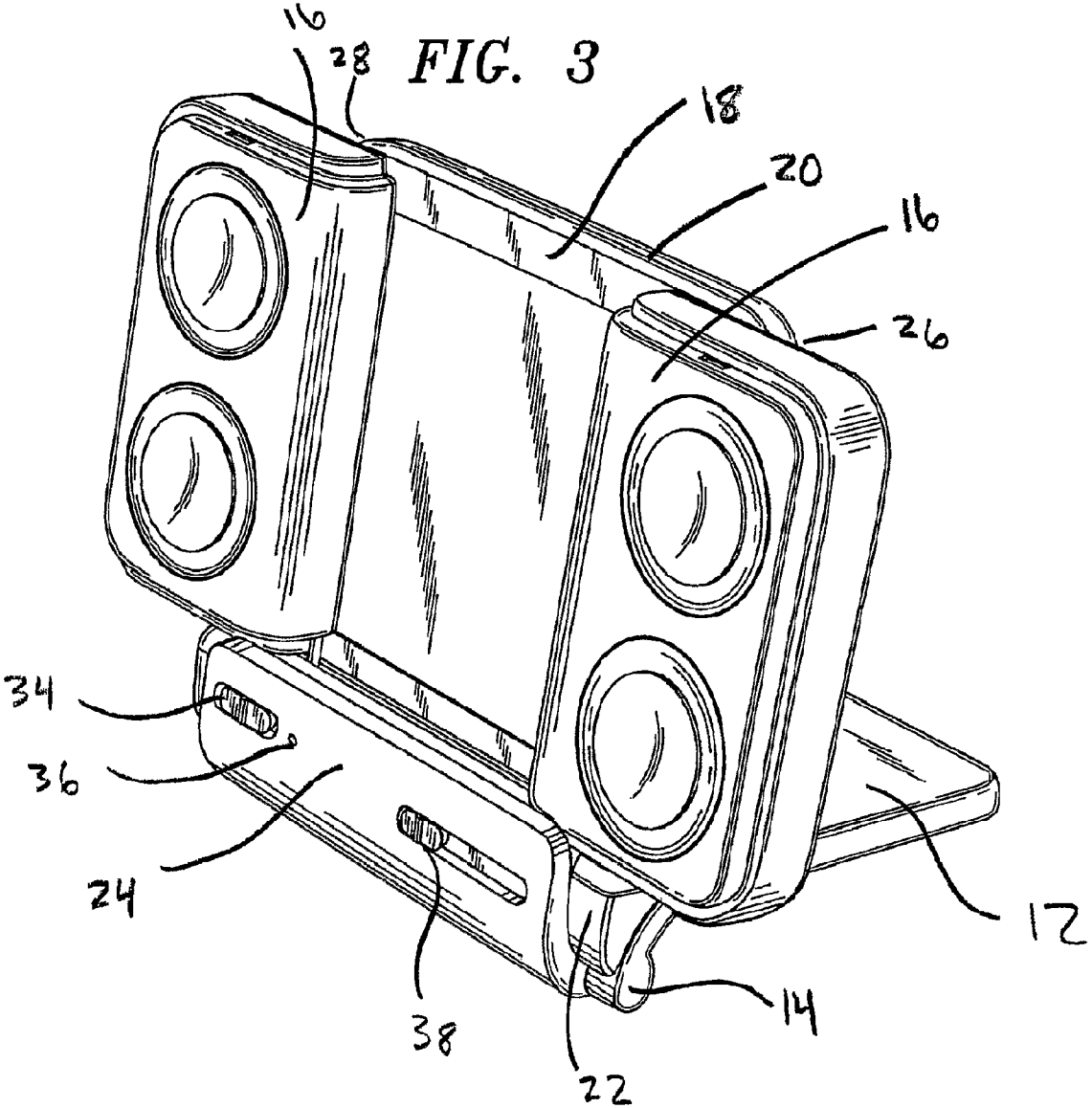
FIG. 3 is a perspective view of the portable speaker system of FIG. 1 (with the support in fully open/supporting position and speakers in open/extended position)
Figure 4:
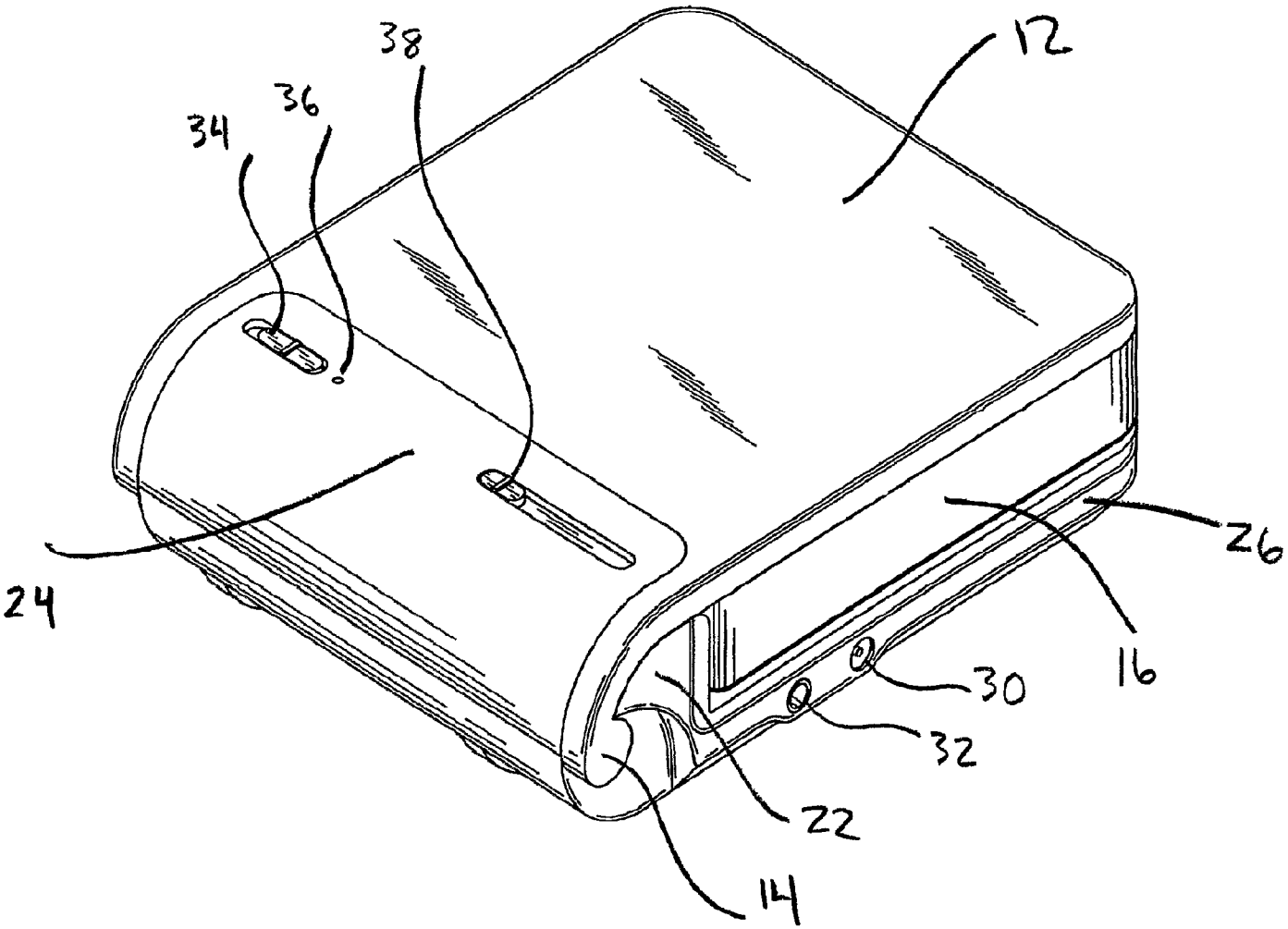
FIG. 4 is a perspective view of the portable speaker system of FIG. 1 (with the support in closed/covering position)
Figure 5:
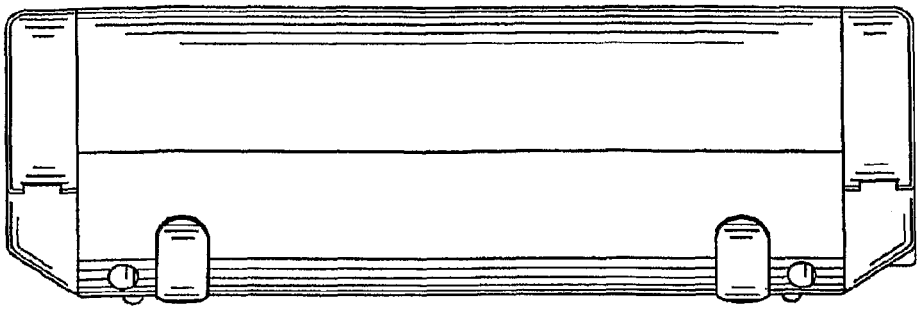
FIG. 5 is a front elevation view of the portable speaker system of FIG. 4.
Figure 6:
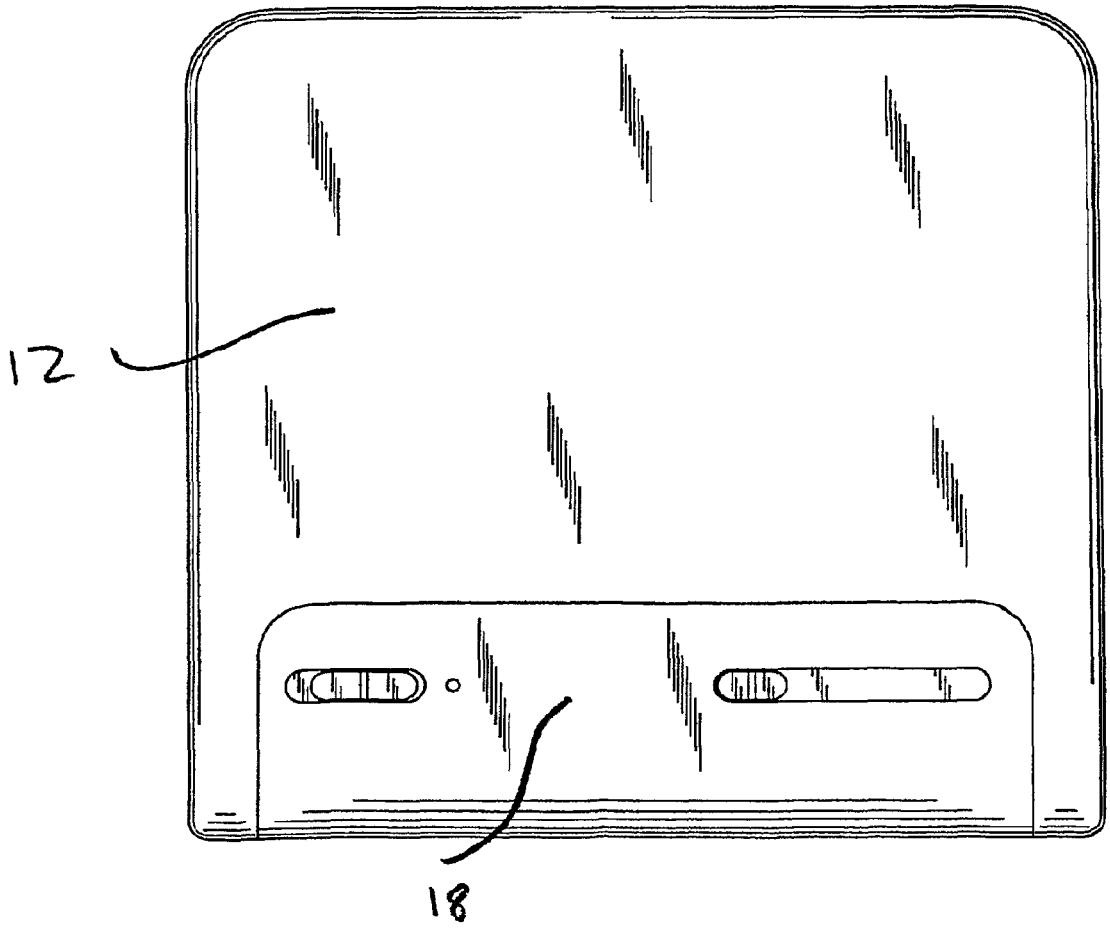
FIG. 6 is a top plan view of the portable speaker system of FIG. 4.
Figure 7:
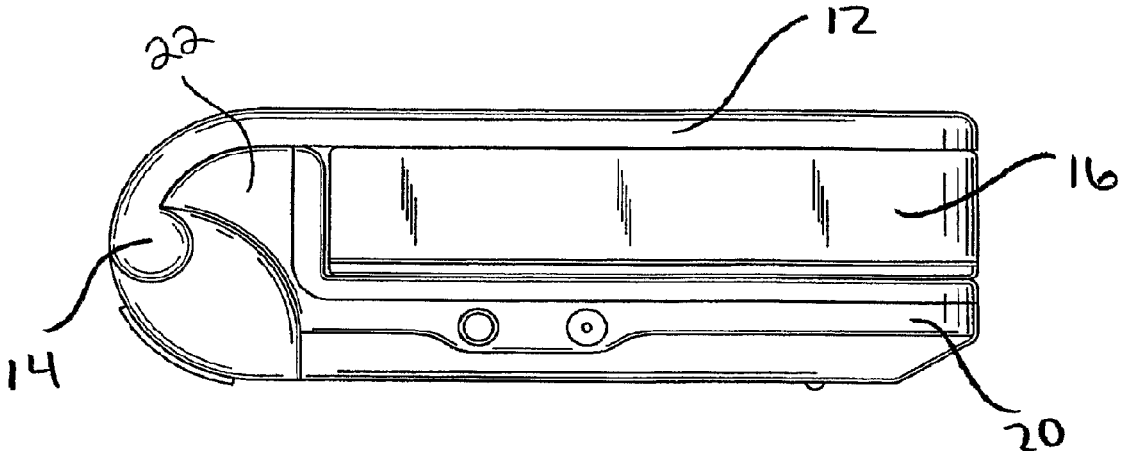
FIG. 7 is a right side elevation view of the portable speaker system of FIG. 4.
Figure 8:
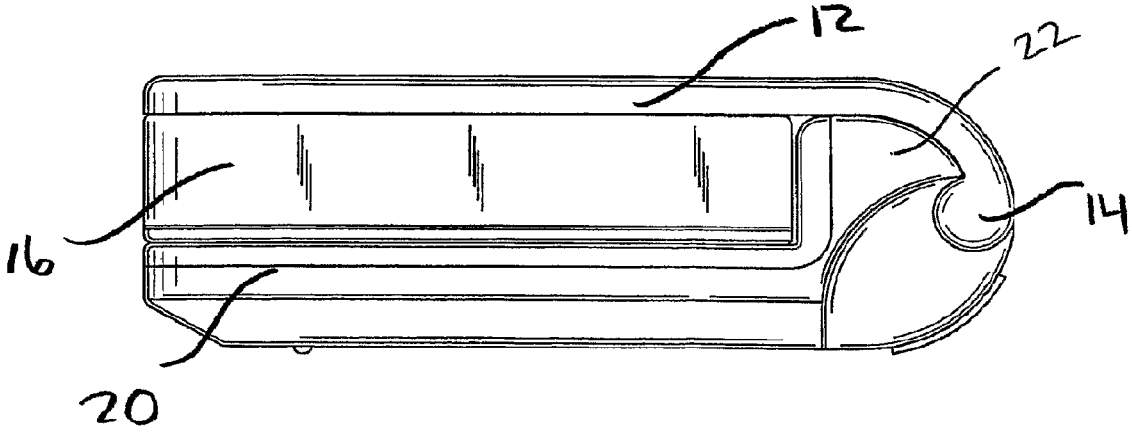
FIG. 8 is a left side elevation view of the portable speaker system of FIG. 4.
Figure 9:
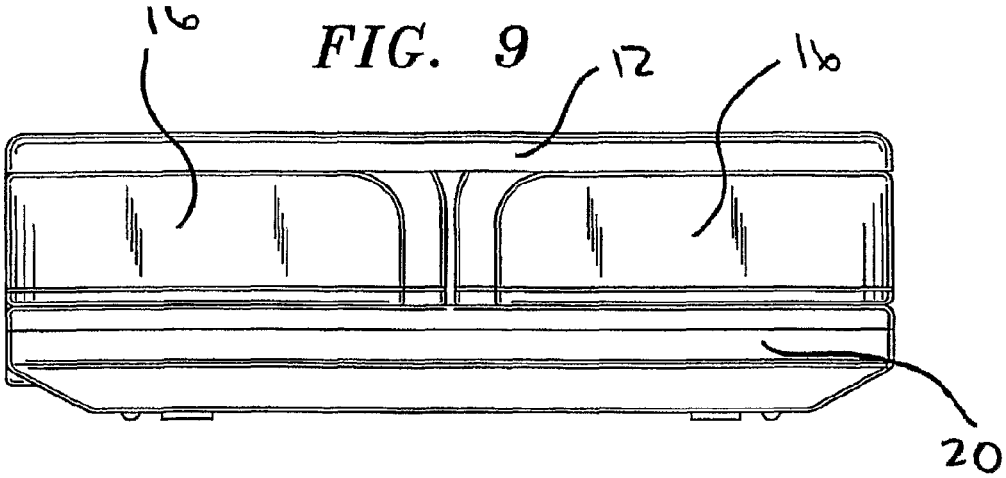
FIG. 9 is a rear elevation view of the portable speaker system of FIG. 4.
Figure 10:
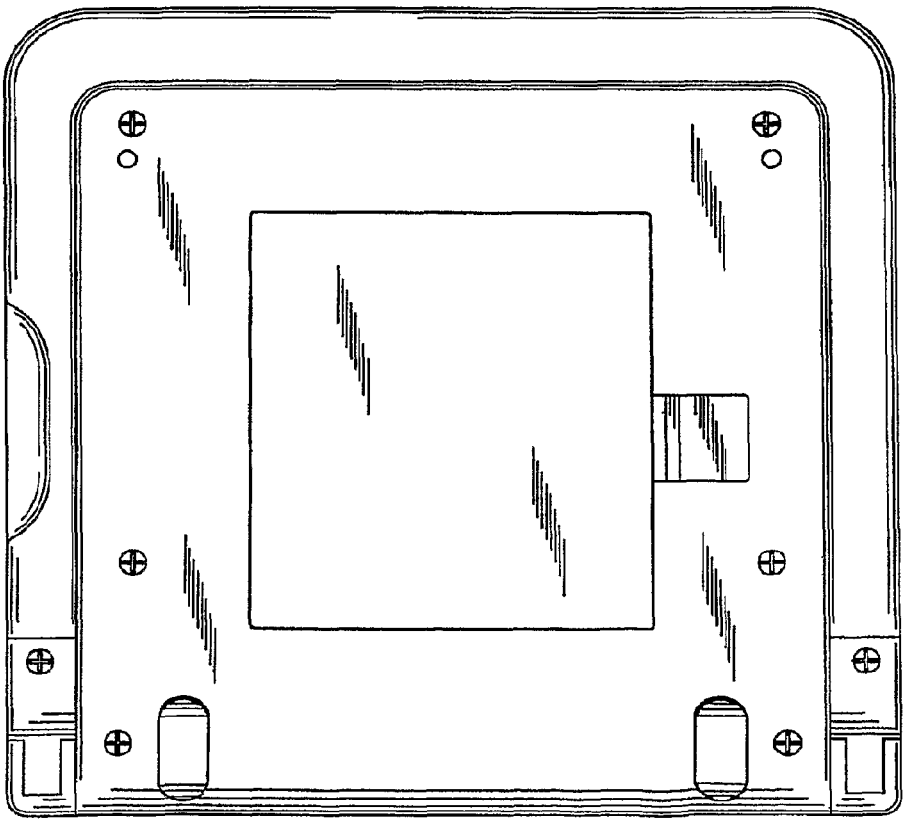
FIG. 10 is a bottom plan view of the portable speaker system of FIG. 4.
Figure 11:
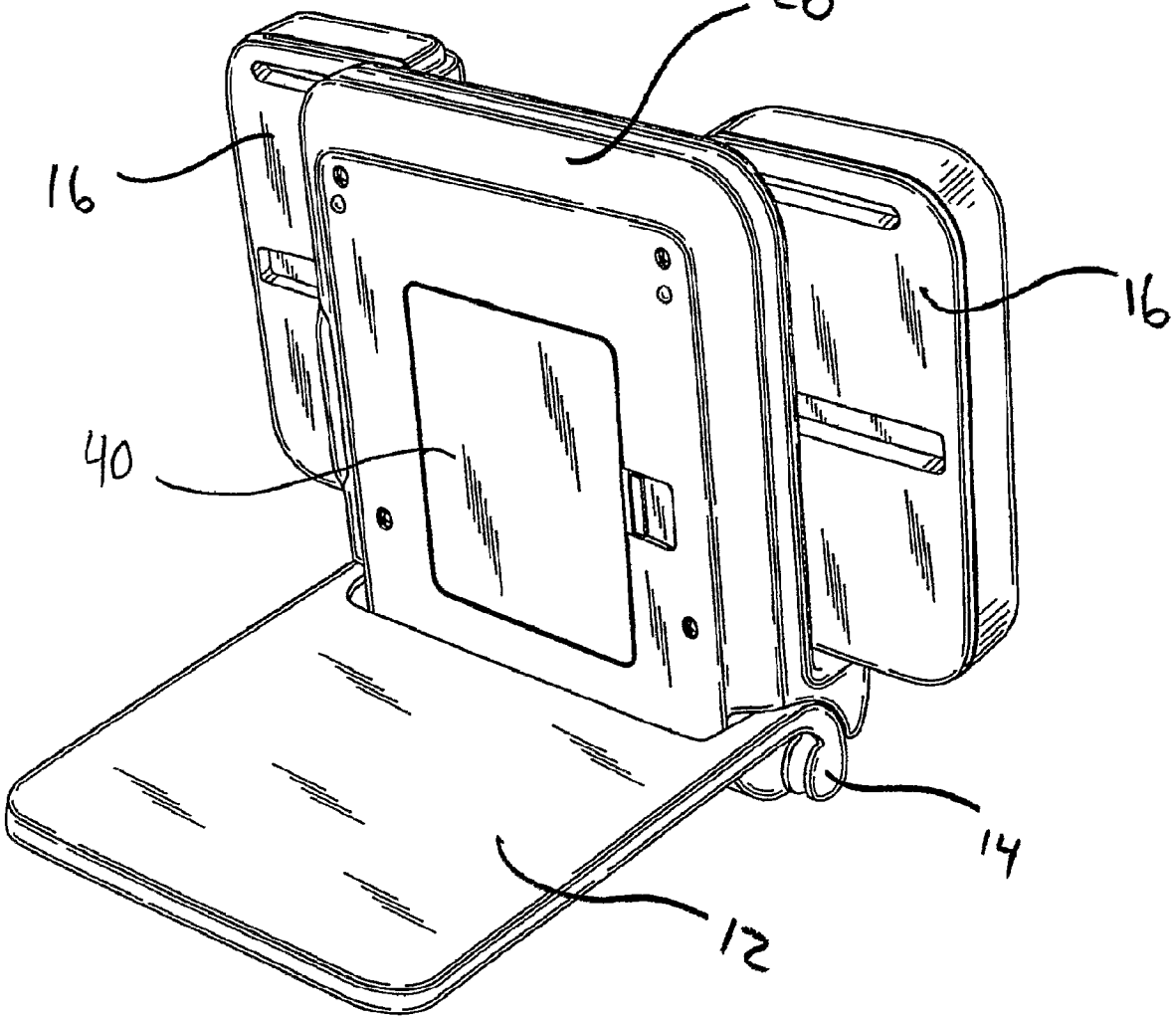
FIG. 11 is a perspective view of the Portable Speakers of FIG. 1 (with the support in fully open/supporting position and speakers in open/extended position).

As shown in FIGS. 1-11, the portable speaker device includes a frame that includes portions 20, 24, 26, and 28. Attached to the frame are speakers 16 that are slidably connected to the frame such that they can be in a closed/retracted position or an open/extended position. The device also includes a support 12 that can be in a supporting position as shown in FIG. 1 or a covering position as shown in FIG. 4. Additionally, the portable speaker device may include a power on/off switch 34 and/or a volume/mixer control switch 38. Either or both of the switches may be associated with a Light Emitting Diode ("LED") 36. The portable speaker device 10 may also include one or more inputs and/or outputs 30 and 32 such as audio outputs for headphones or a power input for connecting the device 10 to an external power source. Alternatively, batteries may be provided, for example, under cover 40. Of course, additional controls, inputs and outputs may also be provided without departing from the scope of the present invention.

The support 12 may be rotatably connected to the frame of the portable speaker device at, for example, area 14. As most conveniently illustrated in FIGS. 7 and 8, the support 22 includes arcuate arms 14 that are rotatably coupled to the frame. In addition a contoured element 22 is provided. Together, these elements comprise a flush hinged sub-assembly.

The contoured element 22 is specifically shaped such that one side of the contoured element mates with a respective side of the arcuate arm 14 to form a continuous surface on the exterior of the frame in the supporting position and another side of contoured elements mates with another respective side of the arcuate arm 14 to form a continuous surface on the exterior of the frame in the covering position. The element 22 also provides a stop for the rotation of the support 12 at about 270 degrees (in embodiments, the stop position may be provided at about 200-300 degrees).

Although the flushed hinge sub-assembly is not required, several advantages of this sub-assembly may exist. For example, hinges may be less prone to breaking because the force required to separate the support from the frame is greater because of the contoured element 22. Additionally, the sub-assembly may provide additional support for the portable speaker device 10 while in use and therefore the portable speaker device 10 may be more stable. The contoured element 22 may also provide improved mechanical integrity for the device and/or a sealing function to protect the speakers.

In addition to communicatively coupling through a docking port or the like, an embodiment of the present invention also allows external devices, such as, but not limited to, audio signals from a computer, secondary audio device, or the like, to be communicatively coupled to the portable speaker system through a standard audio connector. The physical and electronic components and processes necessary to accomplish these functions are well known in the art and will not be described herein. Electronic mixing circuitry may allow audio signals from the external device to be input to, and reproduced by, the portable speaker system in conjunction with an audio signal from an attached portable audio device or other device.

An adapter may also be provided by which the present invention can be mated with higher fidelity audio equipment. Such higher fidelity audio equipment may include, but is not limited to, a subwoofer or a home theater system. This can further enhance the audio fidelity and reproduced frequency range of the system.

Further, a power adapter may allow the portable speaker system 10 of the present invention to be powered from an external power source, such as, but not limited to, an AC to DC converter or an external battery pack. In addition to receiving power from an external power source, the portable speaker system 10 can also be powered by one or more batteries, which may be stored within the portable speaker system 10. Access to such compartments can be provided through removable covers (such as cover 40). Although rechargeable batteries, such as, but not limited to, lithium ion batteries, may be preferred, it should be apparent to one skilled in the art that disposable batteries can be substituted without departing from the spirit or the scope of the present invention.

In an embodiment in which rechargeable batteries are used, the rechargeable batteries may be recharged any time the portable speaker system is connected to an external power source. The portable speaker system may also charge the batteries, and receive power, if a device implementing Universal Serial Bus (USB), FireWire, or other such interface standards are connected thereto. In an embodiment in which rechargeable batteries are used, the batteries should be of a capacity such that, if the portable speaker system is disconnected from the external power source when the batteries are fully charged, the portable speaker system can be powered and reproduce audio signals for several consecutive hours without needing to be recharged.

In certain embodiments, power from an external power source and/or the batteries may be used to power a Class D or other audio amplifier housed within the portable speaker system, as well as other aspects of the invention. A Class D amplifier may be preferred because of the relatively high efficiencies associated with such amplifiers. Such efficiencies provide reduced power consumption over conventional amplifiers, thereby improving the system's battery life. The amplifier may be used to convert the audio signals from a portable audio device via a docking cradle and/or from an external audio source connected to the present invention through an external audio input jack, into a signal capable of driving the speakers. The physical and electronic components and processes necessary to accomplish these functions are well known in the art and will not be described herein.

An embodiment of the present invention also includes a differential-input mixer, which is capable of combining audio signals from a portable a audio device with audio signals from an external audio source, for example A differential-input mixer is preferred as this can reduce the amount of noise propagated through the portable speaker system. Examples of noise which can be reduced by a differential-input mixer include, but are not limited to, noise generated by the power supply in the portable audio device, noise generated by an external audio device's power supply, noise generated by the power supply within the portable speaker system, noise from an AC to DC converter, and the like.

Mixer controls may allow a user to adjust the relative strength with which each of the audio signals will be reproduced. By way of example, without intending to limit the present invention, a user can elect to listen solely to an audio signal from a first audio device, solely to an audio signal from an external audio source, or to a combination of the two audio signals, with, by way of example, twenty-five percent of the overall reproduced audio coming from the first audio device and the remaining seventy-five percent coming from the external audio source.

Although the previous example includes specific percentages, it should be apparent to one skilled in the art that mixer controls can allow a user to select from an effectively infinite set of input ratios. If the user has elected to have audio reproduced by the present invention include audio signals from multiple inputs, and if the portable speaker system does not detect a device attached to one of the inputs, the present invention may automatically adjust the reproduced audio to be exclusively from the input on which an audio signal is detected. In addition to setting the relative volume of the inputs through a mixer control, a user can also set the overall output level, or volume, by adjusting a volume control.

Regardless of whether the mixer control is implemented, the controls (mixer and/or volume) also may control audio signals sent to a headphone jack 30. Locating the headphone jack 30, cable port 32, power port, and audio input jack near each other may be preferred because it simplifies connecting the portable speaker system to, and disconnecting the portable speaker system from, the attached devices. Although locating the headphone jack near the cable port, power adapter, and audio input jack may be preferred, it should be apparent to one skilled in the art that the physical location of headphone jack, cable port, power adapter, and audio input jack can be varied without departing from the spirit or the scope of the invention. By way of example, without intending to limit the present invention, the headphone jack may be located on the side of the portable speaker device.

When the audio device is communicatively coupled with the portable speaker system 10, the portable audio device may also receive power from the portable speaker system 10. In one embodiment, the portable speaker system 10 may only supply power to audio device when the portable speaker system is receiving power from an external power source, such as, but not limited to, an AC to DC converter, or to an external device capable of providing power to the portable speaker system.

In an alternative embodiment, the portable speaker system 10 may supply power to the audio device regardless of whether the portable speaker system is operating on power from an external power source or from internal batteries. In addition to allowing the portable audio device to function, power supplied by the portable speaker system 10 to the portable audio device may also allow portable audio devices to charge any rechargeable batteries stored therein. Alternatively, the audio device may provide power to the portable speaker system 10.

In an embodiment, a bar (e.g., element 18 in the figures), which is formed in the rear portion of the speakers, may include a rubber pad (not pictured). The rubber pad can provide additional isolation between the portable audio device and the portable speaker system 10. The bar 18 also may prevent the portable speaker system 10 from accidentally closing while the portable speaker system 10 is open and the portable audio device is attached thereto.

In an embodiment, by depressing a latch, a user can unlock the speakers and articulate the speakers around hinge, thereby exposing the speakers. Detents may be provided for controlling the angle of the speakers with respect to the protective surface in certain embodiments. In another embodiment, the speakers can be held closed against the support via friction or a passive latch. The hinge may be a hollow, barrel-type hinge, with cables for speakers running therethrough. One or more grommets may be used to isolate the vibrations from the speakers from the rest of the portable speaker system. It is preferable but not required that the grommets are rubber. They may also be made of other similarly suitable material. Rubber pad and rubber feet can further isolate the portable audio system, speakers, and portable audio device from any vibrations. Likewise, the pad and feet do not have to be made of rubber. They can be made of other similarly suitable materials, instead. The physical components and processes necessary to accomplish these functions are well known in the art and will not be described herein.

In an exemplary embodiment, when a user opens the portable speaker system 10 (i.e. transforms the portable speaker system from a closed state to an open state), the user preferably rotates the speakers approximately 270 degrees around a hinge until the speakers come to rest. This allows the speakers to be positioned at an angle that best aligns speakers with an anticipated user position when the portable speaker system is used on a desk or other surface and positioned within arm's reach of the user. Although an approximately 270 degree rotation is described, it should be apparent to one skilled in the art that the hinge stop position can be made adjustable, and that alternative rotation angles may be substituted therefor without departing from the spirit or the scope of the invention.

Although the illustrated invention permits speakers to be positioned by way of a hinge, alternative speaker positioning means are also envisioned. In one embodiment, the portable speaker system may be of a "clamshell" design. In such an embodiment, the support or cover may sit against the desk or other surface on which the portable speaker system rests, and speakers may be hinged such that they fold down and are covered by protective surface when the portable speaker system is closed.

The portable speaker system 10 may be equipped with a power switch 34 which allows a user to easily turn the system on and off. A Light Emitting Diode 36 ("LED") may be capable of displaying a plurality of colors and thereby conveying information to a user. By way of example, without intending to limit the present invention, the LED 36 may be powered off, or dark, when the portable speaker system is turned off, may glow green when the portable speaker system is connected to an external power source, may glow yellow when the portable speaker system is being powered by batteries, and may glow red when the portable speaker system is being powered by batteries and the estimated remaining battery power drops below a given threshold.

Although the power switch 34 can be used to turn the portable speaker system 10 on and off, the portable speaker system 10 may ignore attempts to turn the portable speaker system 10 on when the portable speaker system 10 is closed. The portable speaker system may also automatically power off when closed. These features can help prevent draining the batteries when the portable speaker system is not in use.

In embodiments, the portable speaker system 10 may be easily connected to a wide range of high fidelity audio equipment, such as, but not limited to, subwoofer or a home theater system. The portable speaker system may also receive power and audio signals from the high fidelity audio equipment and can thereby allow audio signals from audio devices and audio input jacks to be routed through an amplifier in, for example, the subwoofer prior to being reproduced by the speakers. Still further, cable ports 32 can allow the portable audio device to interface with a computer or other such device via the docking cradle.

In an alternative embodiment, an audio adapter may be located on the bottom of the portable speaker system, thereby allowing the portable speaker system to connect with the high fidelity audio equipment by way of a docking cradle or other such attachment means. Such an arrangement may reduce the number of cables and other connectors a user must deal with when connecting and disconnecting the portable speaker system.

Although the illustrated embodiment of the present invention may not permit the portable audio device to be stored within the portable speaker system when closed, as illustrated in the figures, a docking port may accessible even with the portable speaker system 10 is closed. This can allow the portable speaker system to charge the portable audio device regardless of whether the portable speaker system is open or closed.

In an alternative embodiment, the portable speaker system 10 may be configured to permit the portable audio device to be stored therein as the portable speaker system is being transported. For example, within a space provided in front of or behind the speakers when in the retracted position. In such an embodiment, the portable speaker system may recharge the portable audio device as needed.

Additional connectors, such as those supporting the Universal Serial Bus, Fire Wire, or other such standards, may also be added to the portable speaker system, either individually or as part of cable port. Such connectors may allow the portable speaker system 10 to replace a docking station traditionally associated with an the portable audio device, thus enabling the portable audio device to synchronize files with a computer.

The portable speaker system may also be equipped with one or more handles or carrying straps. This can facilitate easily transporting the portable speaker system 10.

Many alterations and modifications of the present invention will be comprehended by a person skilled in the art after having read the foregoing description. It is to be understood that the particular embodiments shown and described by way of illustration are in no way intended to be considered limiting. Therefore, references to details of particular embodiments are not intended to limit the scope of the claims, which in themselves recite only those features regarded as essential to the invention.

The embodiments described herein are intended to be illustrative of this invention. As will be recognized by those of ordinary skill in the art, various modifications and changes can be made to these embodiments and such variations and modifications would remain within the spirit and scope of the invention defined in the appended claims and their equivalents. Additional advantages and modifications will readily occur to those of ordinary skill in the art. Therefore, the invention in its broader aspects is not limited to the specific details and representative embodiments shown and described herein.

What is claimed is:

1. A portable speaker device, comprising:

a frame configured to receive a portable audio device;

at least two speakers slidably-connected to the frame so as to define a linear sliding axis for the speakers, wherein the at least two speakers can be placed in a first position for providing an extended configuration and a second position for providing a retracted configuration; and a support that is rotatably connected to the frame, wherein the support is rotatable between a supporting position where the at least two speakers are exposed and a covering position where the at least two speakers are at least partially covered by the support.

2. The portable speaker device of claim 1 wherein when the at least two speakers are placed in the extended configuration, a space is provided between the at least two speakers that is sufficient to accommodate the portable audio device.

3. The portable speaker device of claim 2 wherein when the at least two speakers are placed in the retracted configuration, the space provided between the at least two speakers that is sufficient to accommodate the portable audio device is substantially eliminated.

4. The portable speaker device of claim 1 further comprising an electrical connector for connecting the portable audio device to the frame, wherein the electrical connector is substantially covered when the at least two speakers are in the retracted configuration.

5. The portable speaker device of claim 4 wherein the electrical connector is a docking cradle for receiving the portable audio device.

6. The portable speaker device of claim 1 wherein the at least two speakers are rotatable around an axis that is substantially parallel to the sliding axis of the at least two speakers.

7. The portable speaker device of claim 1 further comprising a flush hinged sub-assembly for rotatably connecting the support to the frame, the flush hinged sub-assembly comprising:

arcuate arms extending from the support and rotatably coupled to the frame at distal ends; and a contoured element fixedly attached to the frame and shaped such that it mates with a respective side of the arcuate arm to form a continuous surface on the exterior of the frame in the supporting position, and such that it mates with another respective side of the arcuate arm to form a continuous surface on the exterior of the frame in the covering position.

8. The portable speaker device of claim 7 wherein the contoured element provides additional support to the portable speaker device when the support is in the supporting position and increases the force required to separate the support from the frame.

9. The portable speaker device of claim 7 wherein the contoured element provides at least a partial seal around the support when the support is in the covering position to protect the at least two speakers.

10. The portable speaker device of claim 7 wherein the contoured element is configured to mate with the support at a predetermined position to provide a stopping point for the support in the supporting position that is about 270 degrees from the covering position.

11. The portable speaker device of claim 1 further comprising a space to permit the portable audio device to be stored therein in the retracted configuration.

12. A device, comprising:

a frame configured to receive a portable audio device;

at least two speakers slidably-connected to the frame so as to define a linear sliding axis for the speakers, wherein the at least two speakers have a first position for providing a substantially extended configuration and a second position for providing a substantially retracted configuration;

a support that is rotatably connected to the frame, wherein the support is rotatable between a supporting position where the at least two speakers are exposed and a covering position where the at least two speakers are at least partially covered by the support; and a flush hinged sub-assembly comprising:

arcuate arms extending from the support and rotatably coupled to the frame at distal ends; and a contoured element fixedly attached to the frame and shaped such that it mates with a respective side of the arcuate arm to form a continuous surface on the exterior of the frame in the supporting position, and such that it mates with another respective side of the arcuate arm to form a continuous surface on the exterior of the frame in the covering position.

13. The device of claim 12 wherein when the at least two speakers are placed in the extended configuration, a space is provided between the at least two speakers that is sufficient to accommodate the portable audio device.

14. The device of claim 13 wherein when the at least two speakers are placed in the retracted configuration, the space provided between the at least two speakers that is sufficient to accommodate the portable audio device is substantially eliminated.

15. The device of claim 12 further comprising an electrical connector for connecting the portable audio device to the frame, wherein the electrical connector is substantially covered when the at least two speakers are in the substantially retracted configuration.

16. The device of claim 15 wherein the electrical connector is a docking cradle for receiving the portable audio device.

17. The device of claim 12 wherein the at least two speakers a rotatable around an axis that is substantially parallel to the sliding axis of the at least two speakers.

18. The device of claim 12 wherein the contoured element provides additional support to the portable speaker device when the support is in the supporting position and increases the force required to separate the support from the frame.

19. The device of claim 12 wherein the contoured element provides at least a partial seal around the support when the support is in the closed position to protect the at least two speakers.

20. The device of claim 12 wherein the contoured element is configured to mate with the support at a predetermined position to provide a stopping point for the support in the supporting position that is about 200-300 degrees from the closed position.

21. The device of claim 12 further comprising a space to permit the portable audio device to be stored therein in the retracted configuration.

22. A system for supporting a portable speaker device, the system comprising:

a frame configured to receive a portable audio device;

at least two speakers slidably-connected to the frame so as to define a linear sliding axis for the speakers, wherein the at least two speakers can be placed in a first position for providing an extended configuration and a second position for providing a retracted configuration;

a support that is rotatably connected to the frame, wherein the support is rotatable between a supporting position where the at least two speakers are exposed and a covering position where the at least two speakers are at least partially covered by the support; and a flushed hinge sub-assembly comprising:

arcuate arms extending from the support and rotatably coupled to the frame at distal ends; and a contoured element fixedly attached to the frame and shaped such that it mates with a respective side of the arcuate arm to form a continuous surface on the exterior of the frame in the supporting position, and such that it mates with another respective side of the arcuate arm to form a continuous surface on the exterior of the frame in the covering position.

23. The system of claim 22 wherein when the at least two speakers are in the extended configuration, a space is provided between the at least two speakers that is sufficient to accommodate the portable audio device.

24. The system of claim 23 wherein when the at least two speakers are in the substantially retracted position, the space provided between the at least two speakers that is sufficient to accommodate the portable audio device is substantially eliminated.

25. The system of claim 22 further comprising an electrical connector for connecting the portable audio device to the frame, wherein the electrical connector is substantially covered when the at least two speakers are in the retracted configuration.

26. The system of claim 25 wherein the electrical connector is a docking cradle for receiving the portable audio device.

27. The system of claim 22 wherein the at least two speakers are rotatable around an axis that is substantially parallel to the sliding axis of the at least two speakers.

28. The system of claim 22 wherein the contoured element provides additional support to the portable speaker device when the support is in the supporting position and increases the force required to separate the support from the frame.

29. The system of claim 22 wherein the contoured element provides at least a partial seal around the support when the support is in the covering position to protect the at least two speakers.

30. The system of claim 22 wherein the contoured element is configured to mate with the support at a predetermined position to provide a stopping point for the support in the supporting position that is about 200-300 degrees from the covering position.

31. The system of claim 22 further comprising a space to permit the portable audio device to be stored therein in the retracted configuration.

* * * * *